US010252523B2

(12) United States Patent
Kasai

(10) Patent No.: US 10,252,523 B2
(45) Date of Patent: Apr. 9, 2019

(54) ELEMENT SUBSTRATE, PRINTHEAD, AND PRINTING APPARATUS

(71) Applicant: CANON KABUSHIKI KAISHA, Tokyo (JP)

(72) Inventor: Ryo Kasai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/641,647

(22) Filed: Jul. 5, 2017

(65) Prior Publication Data

US 2018/0029357 A1 Feb. 1, 2018

(30) Foreign Application Priority Data

Jul. 29, 2016 (JP) ..... 2016-150547

(51) Int. Cl.
*B41J 2/045* (2006.01)
*B41J 2/14* (2006.01)

(52) U.S. Cl.
CPC ..... *B41J 2/0455* (2013.01); *B41J 2/0458* (2013.01); *B41J 2/04541* (2013.01); *B41J 2/04543* (2013.01); *B41J 2/14129* (2013.01); *B41J 2202/13* (2013.01)

(58) Field of Classification Search
CPC .. B41J 2/0455; B41J 2/14129; B41J 2/04543; B41J 2/04541; B41J 2/0458; B41J 2202/13
See application file for complete search history.

(56) References Cited

U.S. PATENT DOCUMENTS 7,922,297 B2 4/2011 Guan et al.
8,462,187 B2 6/2013 Nishi
9,321,261 B2 4/2016 Yoshiike
9,597,893 B2 3/2017 Kudo et al.
2009/0174753 A1* 7/2009 Kurokawa ..... B41J 2/04523 347/56
2012/0133724 A1 5/2012 Nishi
2015/0191012 A1 7/2015 Yoshiike

FOREIGN PATENT DOCUMENTS

CN 1613648 A 5/2005
CN 1642742 A 7/2005
CN 1775528 A 5/2006
CN 102529416 A 7/2012
CN 103587244 A 2/2014
CN 104766851 A 7/2015
CN 205344153 U 6/2016

OTHER PUBLICATIONS

Office Action dated Oct. 15, 2018, in counterpart application CN 201710564960.4 (8 pages).

* cited by examiner

*Primary Examiner* — Geoffrey S Mruk
(74) *Attorney, Agent, or Firm* — Venable LLP

(57) ABSTRACT

An element substrate comprises: a plurality of heat elements which include a first heat element and a second heat element configured to supply heat to a liquid for printing; and a plurality of driving circuits which include a first driving circuit configured to drive the first heat element and a second driving circuit configured to drive the second heat element, wherein the plurality of heat elements and the plurality of driving circuits are stacked and arranged on the element substrate, and the first heat element is arranged so as to overlap at least a part of the second driving circuit when viewed from a direction perpendicular to the element substrate.

14 Claims, 13 Drawing Sheets

ELEMENT SUBSTRATE, PRINTHEAD, AND PRINTING APPARATUS

BACKGROUND OF THE INVENTION

Field of the Invention

The present invention relates to an element substrate, a printhead, and a printing apparatus.

Description of the Related Art

Conventionally, there is a printing apparatus that includes a printhead according to an inkjet method of printing by using thermal energy. The inkjet printhead includes, as printing elements, heat elements (heaters) provided at parts communicating with orifices for discharging ink droplets. Then, a current is applied to the heat elements to generate heat. Ink droplets are discharged by film boiling of ink, and printing is performed.

In recent years, a small-sized substrate and a high-density nozzle are required of an inkjet printhead substrate. The number of substrates per wafer is increased by shrinking a substrate area, making it possible to implement a cost reduction. In addition, a relative landing position shift on a paper surface between ink discharge nozzles becomes smaller by packing nozzles densely, making it possible to implement higher image quality.

As described in U.S. Pat. No. 7,922,297, there is a method of planarizing the upper layer of a circuit which drives a heater and providing the heater on the planarized layer as a method of shrinking the substrate area and an area between nozzle arrays. The circuit and the heater are arranged so as to overlap each other in a stacking direction by using this method, making it possible to implement a great shrinkage in substrate size. It is also possible, by inserting the planarized layer below the heater, to ensure the reliability of ink foaming and discharge.

If this arrangement is adopted, however, a heat influence on a transistor immediately below the heater is concerned. Heater heat for foaming ink under heating is mainly transmitted in a direction of not the ink but a substrate immediately below owing to the balance of a heat resistance between an ink side and a substrate side. Consequently, the heater heats its own circuit under driving. This brings about problems of circuit durability, a change in driving characteristics, a malfunction, and the like.

SUMMARY OF THE INVENTION

According to one aspect of the present invention, there is provided an element substrate comprising: a plurality of heat elements which include a first heat element and a second heat element configured to supply heat to a liquid for printing; and a plurality of driving circuits which include a first driving circuit configured to drive the first heat element and a second driving circuit configured to drive the second heat element, wherein the plurality of heat elements and the plurality of driving circuits are stacked and arranged on the element substrate, and the first heat element is arranged so as to overlap at least a part of the second driving circuit when viewed from a direction perpendicular to the element substrate.

According to another aspect of the present invention, there is provided a printhead comprising at least one element substrate, wherein the element substrate includes a plurality of heat elements which include a first heat element and a second heat element configured to supply heat to a liquid for printing, and a plurality of driving circuits which include a first driving circuit configured to drive the first heat element and a second driving circuit configured to drive the second heat element, the plurality of heat elements and the plurality of driving circuits are stacked and arranged on the element substrate, and the first heat element is arranged so as to overlap at least a part of the second driving circuit when viewed from a direction perpendicular to the element substrate.

According to another aspect of the present invention, there is provided a printing apparatus comprising at least one printhead which includes at least one element substrate, wherein the element substrate includes a plurality of heat elements which include a first heat element and a second heat element configured to supply heat to a liquid for printing, and a plurality of driving circuits which include a first driving circuit configured to drive the first heat element and a second driving circuit configured to drive the second heat element, the plurality of heat elements and the plurality of driving circuits are stacked and arranged on the element substrate, and the first heat element is arranged so as to overlap at least a part of the second driving circuit when viewed from a direction perpendicular to the element substrate.

With the present invention, it becomes possible to implement a shrinkage in printhead substrate and a high-density nozzle while maintaining circuit durability and operation reliability.

Further features of the present invention will become apparent from the following description of exemplary embodiments (with reference to the attached drawings).

DESCRIPTION OF THE EMBODIMENTS

Figure 1:
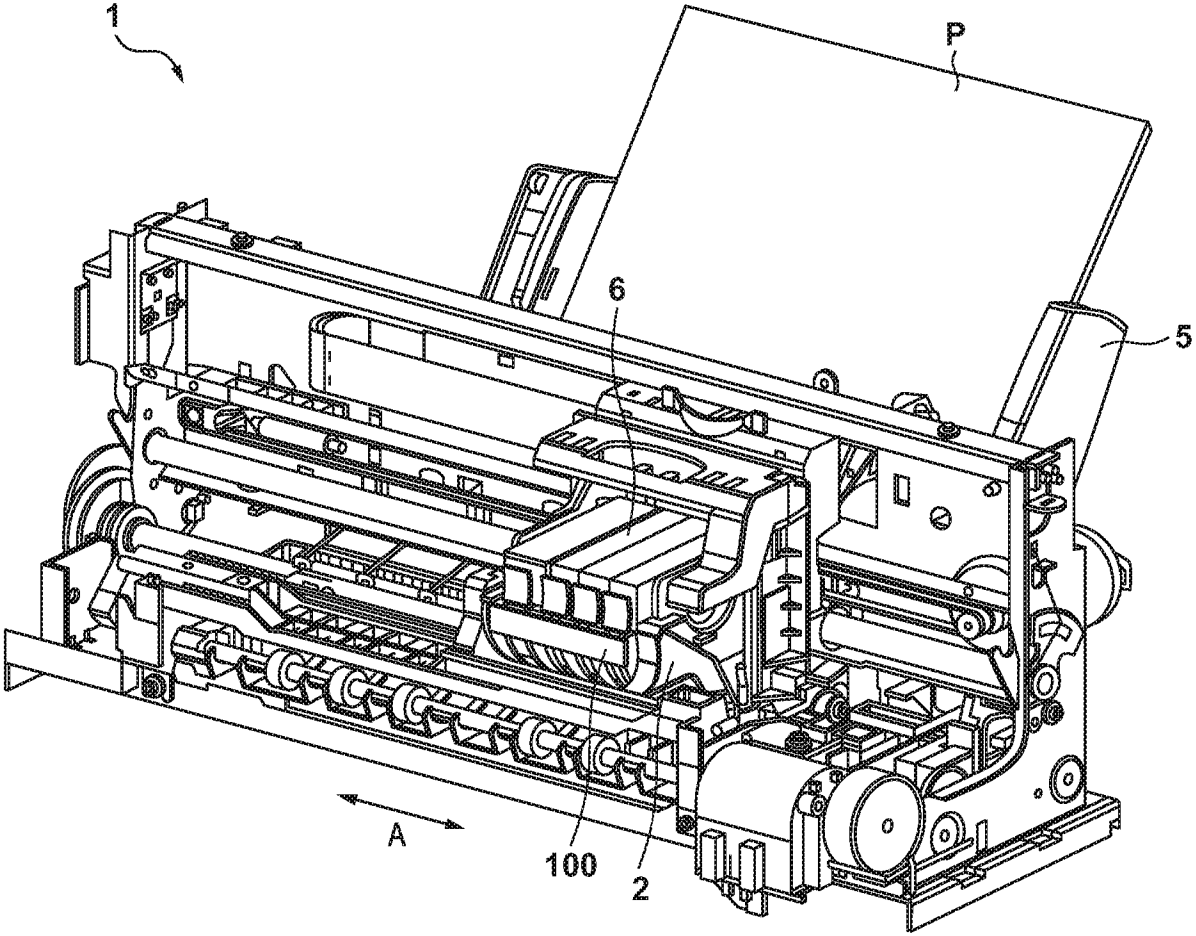
FIG. 1 is a perspective view showing the outer appearance of an inkjet printing apparatus according to the present invention.

Preferred embodiments of the present invention will be described below more concretely and in more detail with reference to the accompanying drawings. It should be noted that the relative arrangement of building components and the like set forth in the embodiment do not limit the scope of the present invention unless it is specifically stated otherwise.

In this specification, the term "printing" (to be also referred to as "print") not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, the term "printing medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted to be similar to the definition of "printing (print)" described above. That is, "ink" includes a liquid which, when applied onto a printing medium, can form images, figures, patterns, and the like, can process the printing medium, or can process ink (for example, solidify or insolubilize a coloring agent contained in ink applied to the printing medium).

Further, a "printing element" generically means an orifice or a liquid channel communicating with it, and an element for generating energy used to discharge ink, unless otherwise specified.

Further, a "nozzle" generically means an orifice or a liquid channel communicating with it, and an element for generating energy used to discharge ink, unless otherwise specified.

A printhead element substrate (head substrate) used below means not merely a base made of a silicon semiconductor, but an arrangement in which elements, wiring lines, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

An inkjet printhead (to be referred to as a printhead hereinafter) which constitutes the most important characteristic of the present invention implements, on the same printhead element substrate, a plurality of printing elements and a driving circuit which drives these printing elements. As seen in a description to be given later, a structure is adopted in which the printhead incorporates a plurality of element substrates, and these element substrates are cascade-connected to each other. It is therefore possible for this printhead to achieve a relatively long printing width. Therefore, the printhead is used not only for a general serial type printing apparatus but also for a printing apparatus which includes a full-line printhead with a printing width corresponding to the width of a printing medium. Further, the printhead is used, out of the serial type printing apparatuses, a large format printer which uses print media of large sizes such as AO and BO sizes.

Therefore, a printing apparatus which uses a printhead of the present invention will be described first.

Overview of Printing Apparatus

FIG. 1 is a perspective view showing the outer appearance of a printing apparatus which prints by using an inkjet printhead (to be referred to as a printhead hereinafter) according to a representative embodiment of the present invention.

As shown in FIG. 1, in the inkjet printing apparatus (to be referred to as a printing apparatus hereinafter) 1, an inkjet printhead (to be referred to as a printhead hereinafter) 100 for discharging ink according to an inkjet method to print is mounted on a carriage 2. The carriage 2 reciprocates in directions indicated by an arrow A to print. The printing apparatus 1 feeds a printing medium P such as printing paper via a sheet supply mechanism 5, and conveys it to a printing position. At the printing position, the printhead 100 discharges ink onto the printing medium P, thereby printing.

The carriage 2 of the printing apparatus 1 not only mounts the printhead 100 but is also equipped with ink tanks 6 each storing ink supplied to the printhead 100. The ink tanks 6 are detachable from the carriage 2.

The printing apparatus 1 shown in FIG. 1 is capable of color printing. For this purpose, four ink cartridges which contain magenta (M), cyan (C), yellow (Y), and black (K) inks are mounted on the carriage 2. These four ink cartridges are independently detachable.

The printhead 100 according to the present invention adopts an inkjet method of discharging ink using thermal energy. Accordingly, the printhead 100 includes electrothermal transducers. These electrothermal transducers are arranged in correspondence with respective orifices. A pulse voltage is applied to an electrothermal transducer corresponding to a printing signal, thereby discharging ink from a corresponding orifice. Note that the printing apparatus is not limited to the serial type printing apparatus described above and is also applicable to a so-called full-line type printing apparatus which arranges a printhead (line head) with orifices arrayed in the widthwise direction of the printing medium in the conveyance direction of the printing medium.

Figure 2:
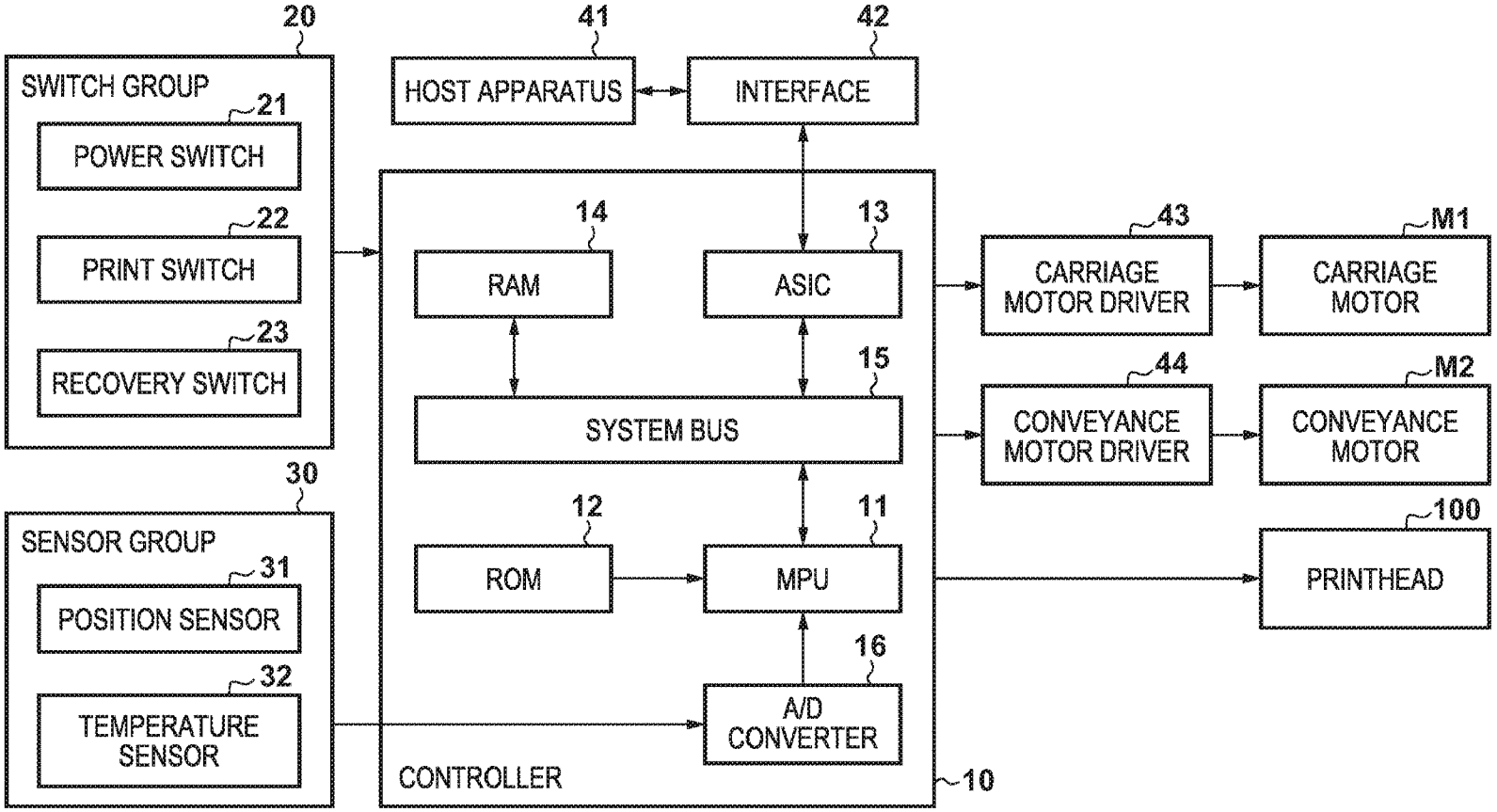
FIG. 2 is a block diagram showing the control arrangement of the inkjet printing apparatus according to the present invention.

FIG. 2 is a block diagram showing the control arrangement of the printing apparatus shown in FIG. 1.

As shown in FIG. 2, a controller 10 includes an MPU 11, a ROM 12, an application specific integrated circuit (ASIC) 13, a RAM 14, a system bus 15, and an A/D converter 16. The ROM 12 stores programs corresponding to various control sequences, necessary tables, and other fixed data. The ASIC 13 generates control signals to control a carriage motor M1, a conveyance motor M2, and the printhead 100. The RAM 14 is used as a rendering area of image data, a work area required to execute a program, and the like. The system bus 15 connects the MPU 11, the ASIC 13, and the RAM 14 to each other and exchanges data. The A/D converter 16 receives an analog signal from a sensor group to be described below, A/D-converts it, and supplies the digital signal to the MPU 11.

Referring to FIG. 2, a host apparatus 41 is an external information processing apparatus such as a PC which serves as an image data supply source. The host apparatus 41 transmits/receives image data, commands, status signals, and the like to/from the printing apparatus 1 via an interface (I/F) 42. Note that as the interface 42, a USB interface may further be provided independently of a network interface to allow reception of bit data or raster data serially transferred from the host.

A switch group 20 includes, for example, a power switch 21, a print switch 22, and a recovery switch 23.

A sensor group 30 configured to detect an apparatus state includes, for example, a position sensor 31 and a temperature sensor 32. The sensor group 30 also includes a photosensor which detects the ink residual amount.

A carriage motor driver 43 drives the carriage motor M1 to reciprocally scan the carriage 2 in the directions of the arrow A. A conveyance motor driver 44 drives the conveyance motor M2 to convey the printing medium P.

The ASIC 13 transfers, to the printhead, data to drive heat elements (heaters for ink discharge) while directly accessing the storage area of the RAM 14 upon print scanning by the printhead 100. This printing apparatus additionally includes, as a user interface, a display unit formed by an LCD or LED.

Figure 3A:
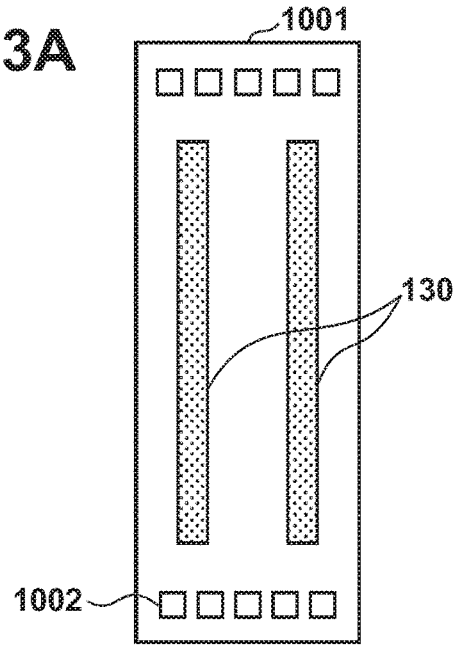
FIGS. 3A and 3B are views schematically showing the outer appearances of a printhead substrate and a printhead.
Figure 3B:
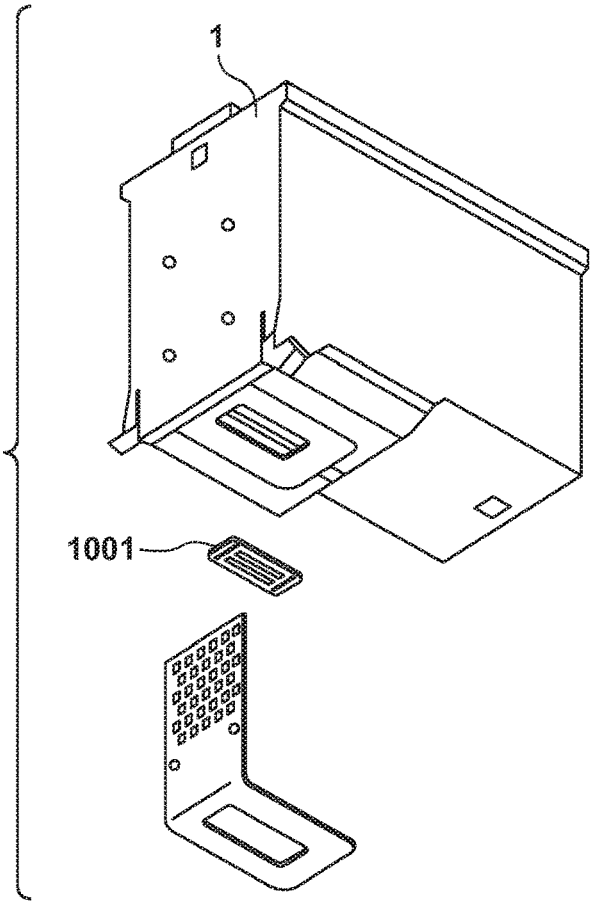

An embodiment of a printhead substrate (element substrate) which forms a liquid discharge head used as a printhead in the printing apparatus of the above-described arrangement will now be described. FIG. 3A schematically shows the outer appearance of a printhead substrate 1001. The printhead substrate 1001 includes ink supply ports 130 from the ink tanks 6 and power supply/signal PADs 1002. FIG. 3B schematically shows the outer appearance of the printhead 100. As described above, the ink tanks 6 are mountable, and ink is supplied from them. Then, the printhead 100 includes the printhead substrate 1001.

First Embodiment

Circuit Arrangement Example

Figure 4:
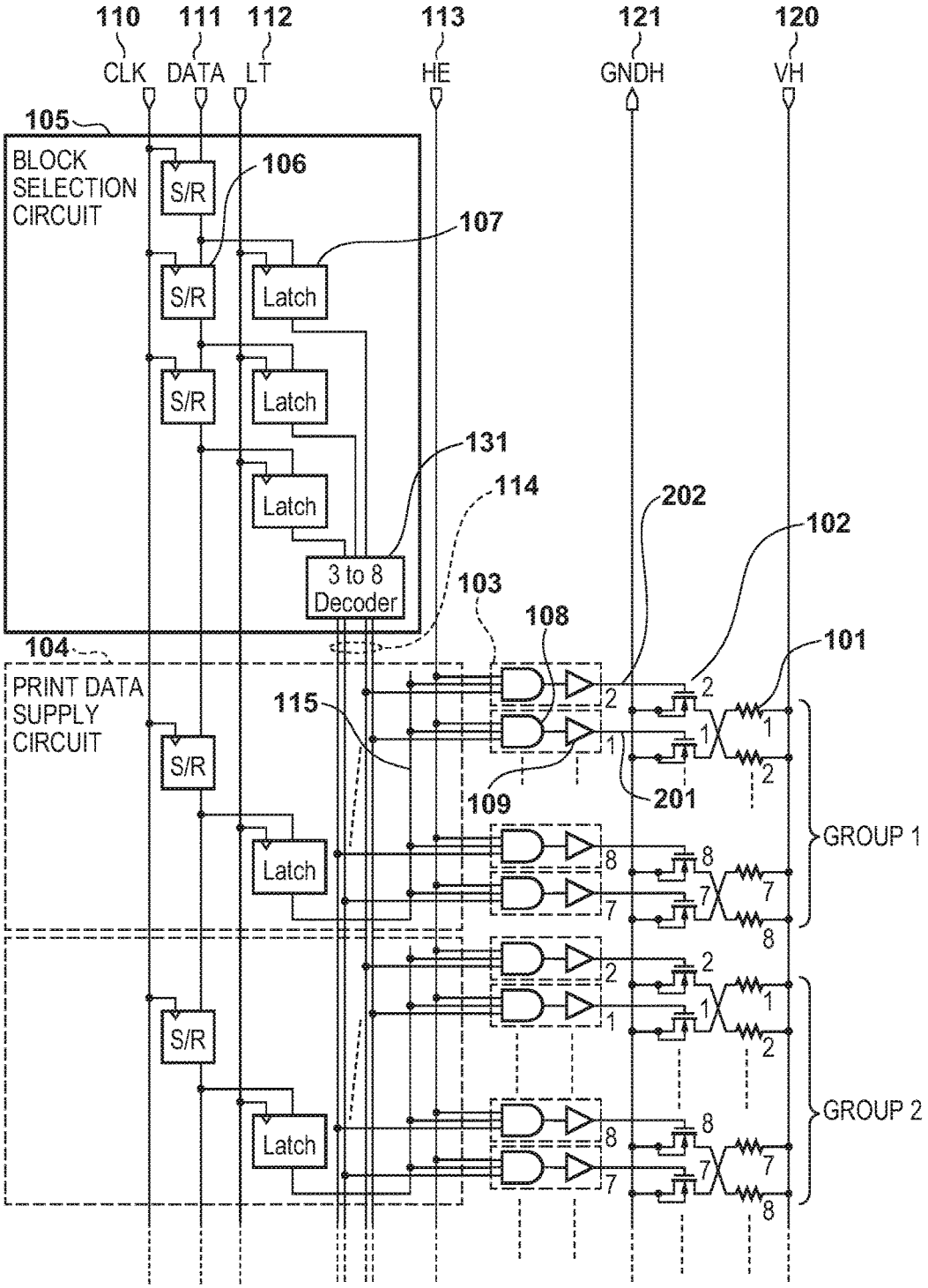
FIG. 4 is a circuit diagram showing a printhead substrate according to the first embodiment.
Figure 5:
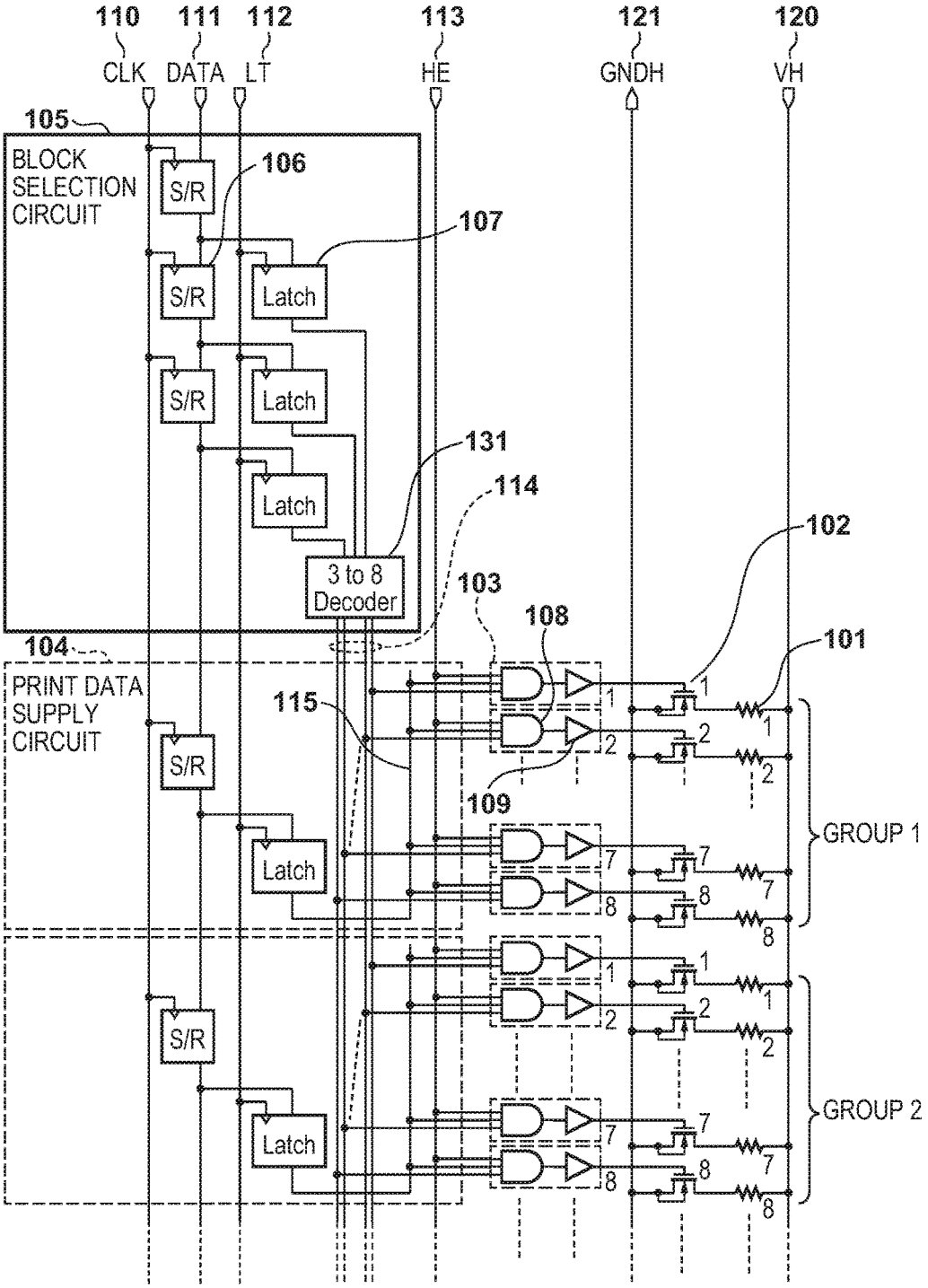
FIG. 5 is a circuit diagram showing a comparative example of a printhead substrate.

FIG. 4 is a diagram showing the circuit arrangement according to this embodiment. FIG. 5 is a diagram showing an example to be compared with the circuit arrangement of the present invention. FIG. 4 is different from FIG. 5 in that wiring connection between each heater 101 and a corresponding one of driver transistors 102 is crossed adjacently.

Figure 6:
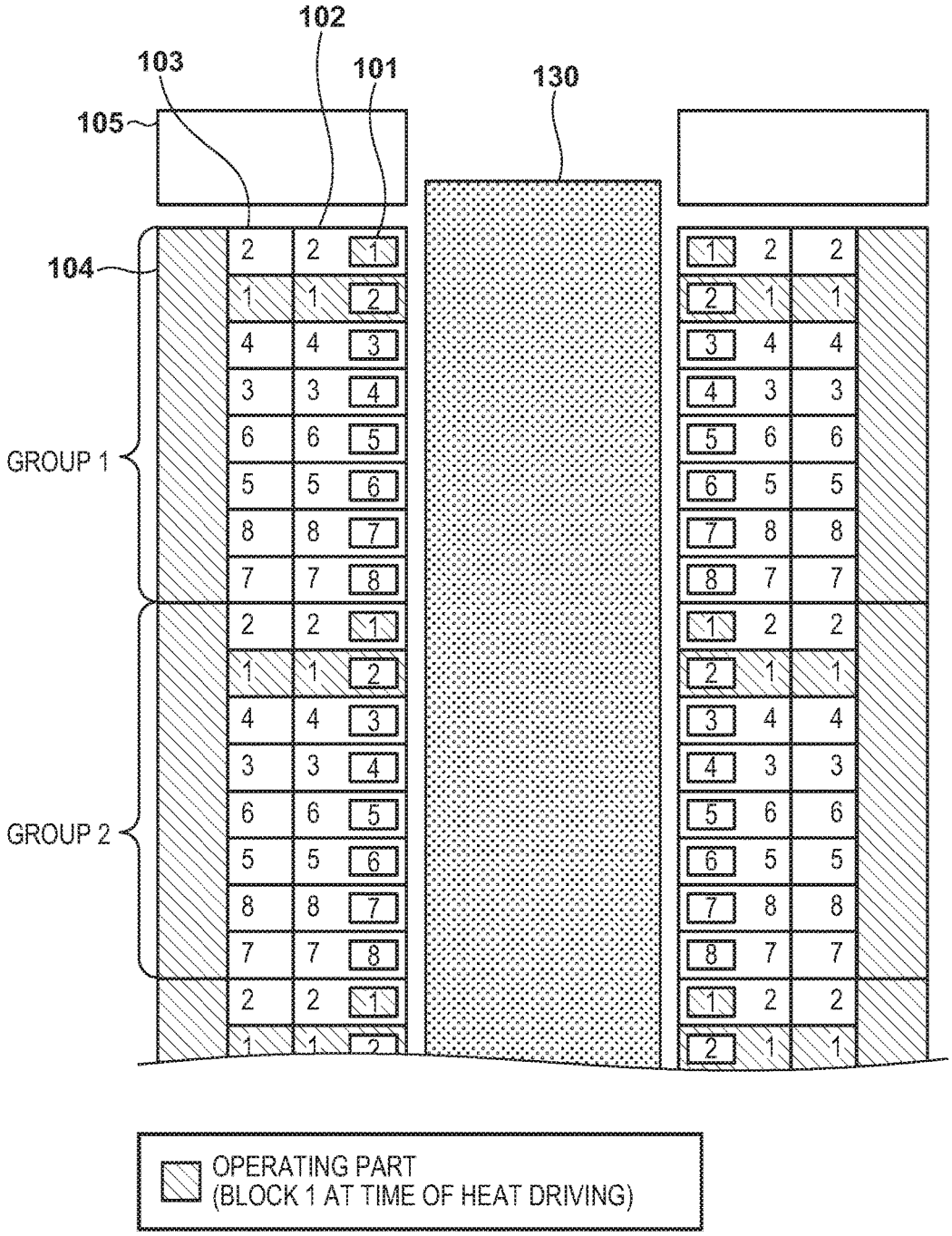
FIG. 6 is a view showing the circuit layout of the printhead substrate according to the first embodiment.
Figure 7:
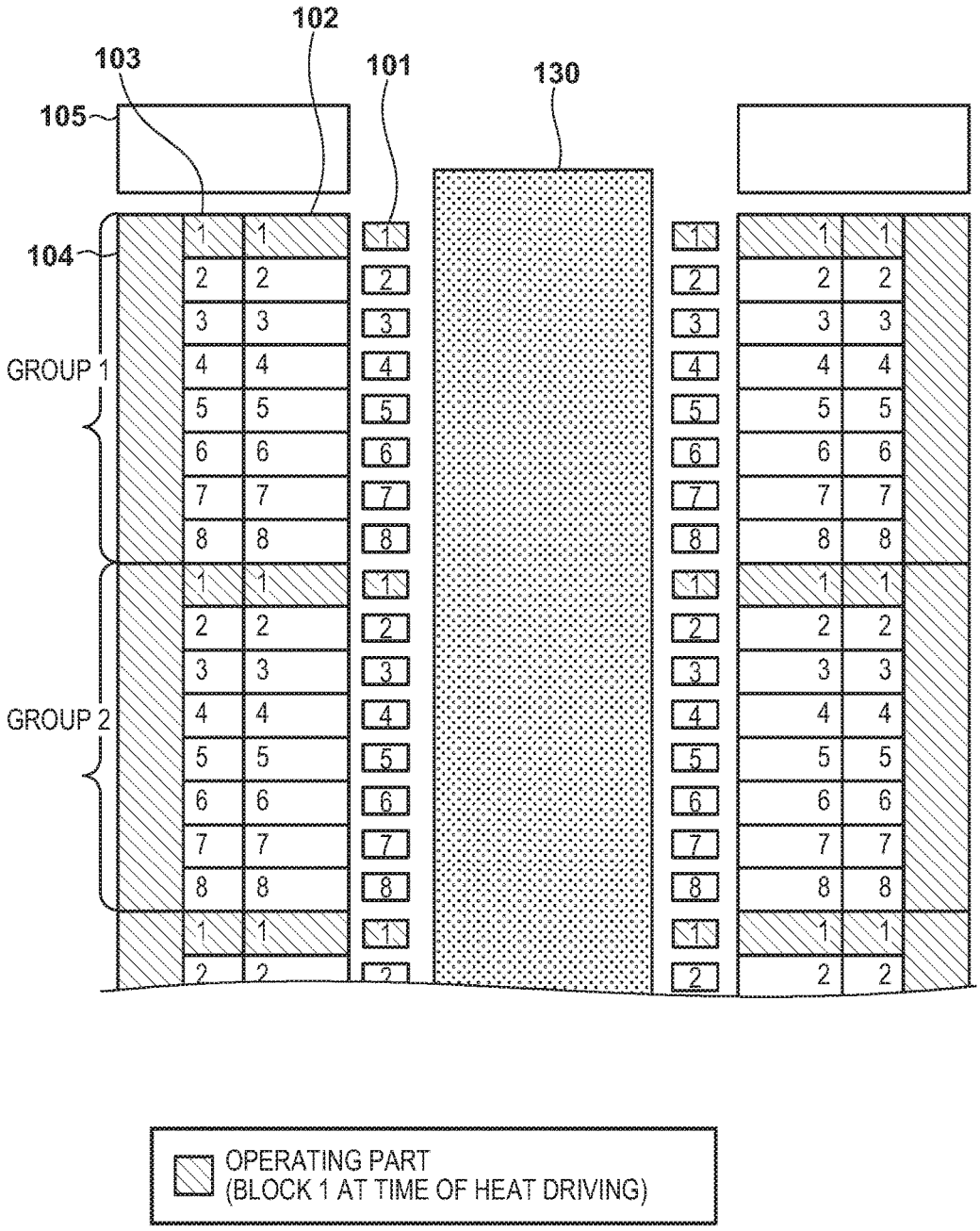
FIG. 7 is a view showing a comparative example of the circuit layout of the printhead substrate.
Figure 8:
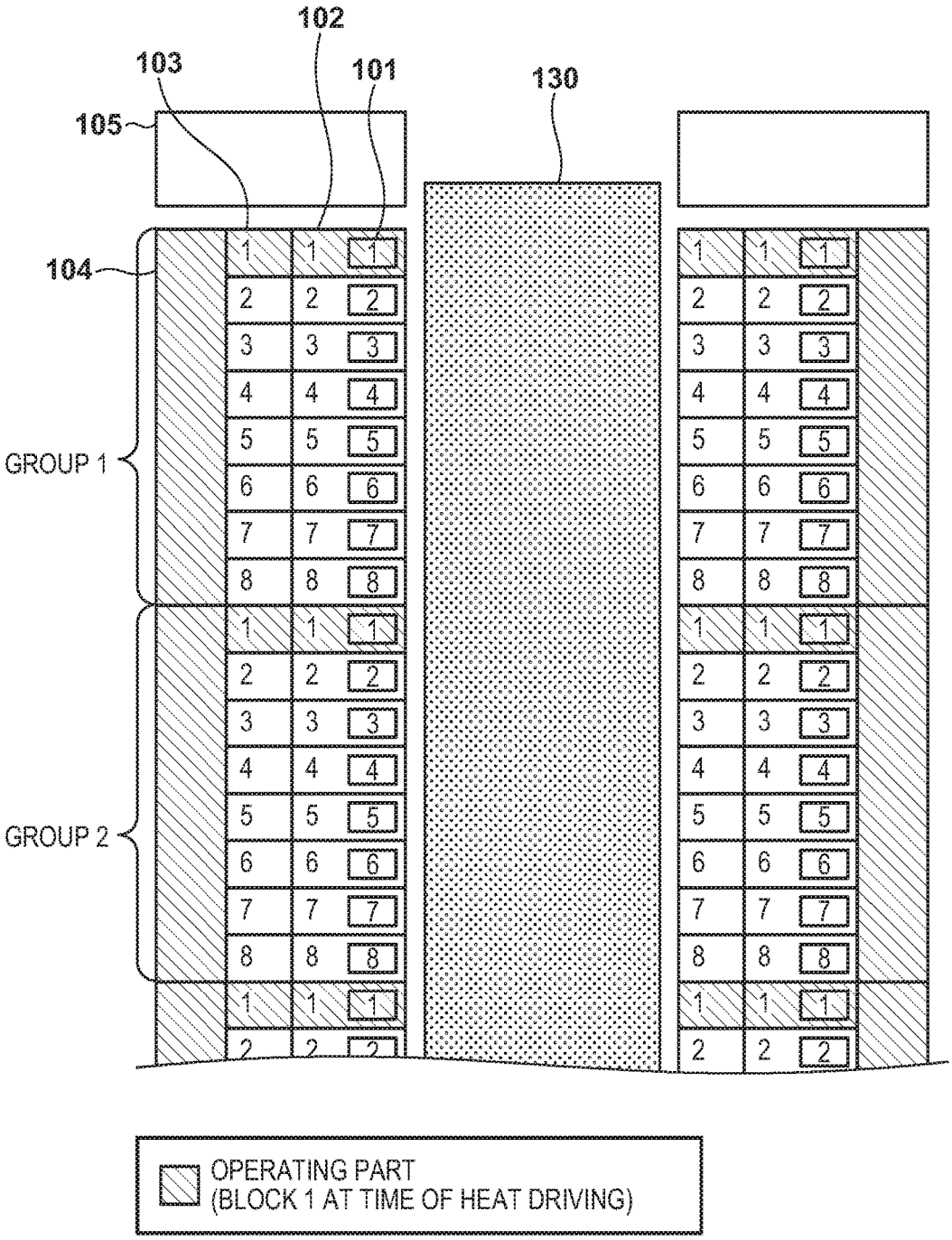
FIG. 8 is a view showing a comparative example of the circuit layout of a printhead substrate.

FIG. 6 is an enlarged view for explaining a portion around the heaters of a printhead substrate according to this embodiment. FIG. 6 is a view showing the printhead substrate when viewed from the vertical direction. FIGS. 7 and 8 are views showing examples to be compared with the portion around the heaters according to the present invention. In this embodiment, a printhead substrate 1001 includes a plurality of groups consisting of a plurality of circuit blocks. In this embodiment, one group is made of eight circuit blocks. However, the present invention is not limited to this. One block includes the heater 101, the driver transistor 102, and a preceding circuit 103. Each preceding circuit 103 is a control circuit which outputs, based on a control signal, a driving signal for driving a corresponding one of the driver transistors 102. Each preceding circuit 103 includes an AND circuit 108 and a booster circuit 109.

Referring to FIGS. 6 to 8, each hatched pattern indicates a part operating at the time of heater driving (block 1). In each group, parts given the same number operate simultaneously. A heat influence and the layout area of the printhead substrate will now be described with reference to each of FIGS. 6 to 8. As shown in FIG. 6, each heater 101 is arranged on the corresponding one of the driver transistors 102 in this embodiment, making it possible to decrease the layout area. On the other hand, in FIG. 7 serving as the comparative example, each heater 101 is not arranged on the corresponding one of driver transistors 102, resulting in the driver transistor 102 being less influenced by heat from the heater 101 but increasing the layout area. In FIG. 8, each heater 101 is arranged on a corresponding one of the driver transistors 102 as in FIG. 6, reducing a layout area but resulting in the driver transistor 102 being influenced by heat from the heater 101. On the other hand, in this embodiment, the driver transistors 102 arranged below the non-driving heaters 101 of block 2 are driven while driving the heaters 101 of block 1, as shown in FIG. 6. That is, the driver transistors 102 immediately below the heaters 101 of this block 1 are not driven at this time. In short, each driver transistor 102 can be driven without being influenced by heat from a corresponding one of the heaters 101 while reducing the layout area.

Operation Timing

Figure 9:
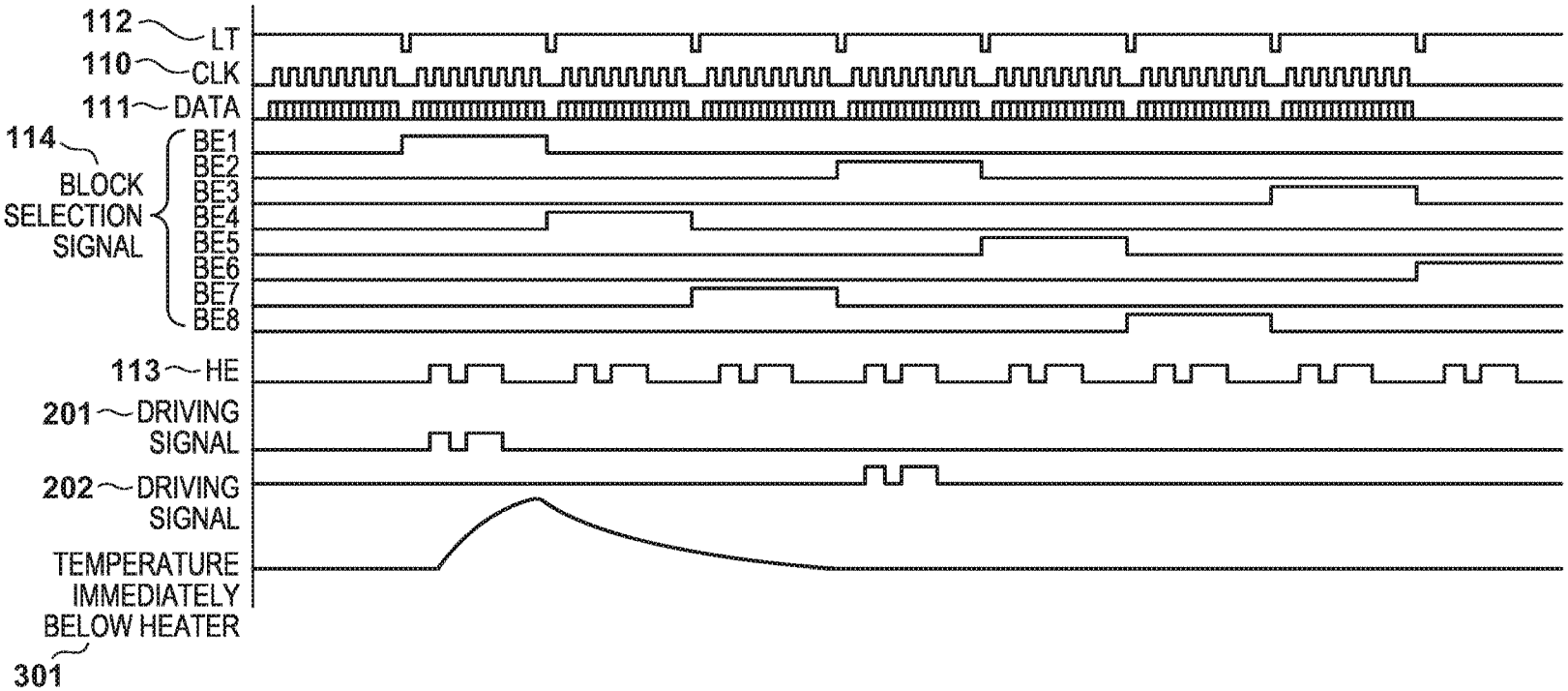
FIG. 9 is a driving timing chart according to the first embodiment.

An operation timing according to this embodiment will be described with reference to FIGS. 4 and 9. FIG. 9 is an operation timing chart according to this embodiment. The heaters 101 are configured to perform time-divisional driving, correspond to eight heaters included in one group on the printhead substrate 1001 according to this embodiment and the printhead substrate according to the comparative example, and selectively drive the heaters sequentially by 8 time division. A CLK 110 indicates a clock. A DATA 111 indicates a data signal. An LT 112 indicates a latch signal. Block selection signals 114 are made of BE1 to BE8 in correspondence with eight heaters.

A block selection circuit 105 selects the heaters based on the DATA 111. In the block selection circuit 105, shift registers 106 receive the DATA 111 in synchronism with the CLK 110. Then, latch circuits 107 hold the data stored in the shift registers 106 at a timing when the LT 112 becomes Low. The data held by the latch circuits 107 is output, as the block selection signals 114, to a print data supply circuit 104 via a decoder 131. The block selection signals 114 are used when one block is selected from blocks 1 to 8 in the group via the decoder 131. The decoder 131 converts each 3-bit signal output from a corresponding one of the latch circuits 107 into an 8-bit signal. The DATA 111 is output to the print data supply circuit 104 via the shift registers 106 of the block selection circuit 105.

Further, each AND circuit 108 included in a corresponding one of the preceding circuits 103 obtains the AND of the block selection signal 114, a print data signal 115, and an HE 113 which defines a heat driving period, and sets it as an output signal. This output signal is amplified in a signal voltage amplitude by each booster circuit 109 and output, as a driving signal 202, to the corresponding one of the driver transistors 102. Each driver transistor 102 switches on a desired heater for a desired period based on a corresponding one of the driving signals 202. Consequently, a current flows from a heater power supply voltage VH 120 to the heaters 101, the heaters 101 are heated, and ink is foamed and discharged. That is, it becomes possible to select each heater 101 to be driven by the matrix of a corresponding one of the block selection signals 114 and the print data signal 115, and to select all the heaters (here, eight heaters included in one group) by a total of eight driving operations. As described above, the heaters 101 given the same number in each group can be driven at the same operation timing.

In an example of FIG. 9, a selection order of the blocks (heaters) in the group is 1→4→7→2→5→8→3→6 as shown in the timing chart of the block selection signals 114. That is, an order is adopted in which a timing when an adjacent nozzle (heater) is driven always occurs three or more blocks later. This is because the nozzle adjacent to the nozzle which performs discharge is influenced by crosstalk, vibrating an ink chamber. To prevent this, the nozzle is operated in a state in which a certain period is left from the discharge of the adjacent nozzle and the crosstalk influence is removed, causing the nozzle to perform discharge stably.

Arrangement Around Heater

Figure 10:
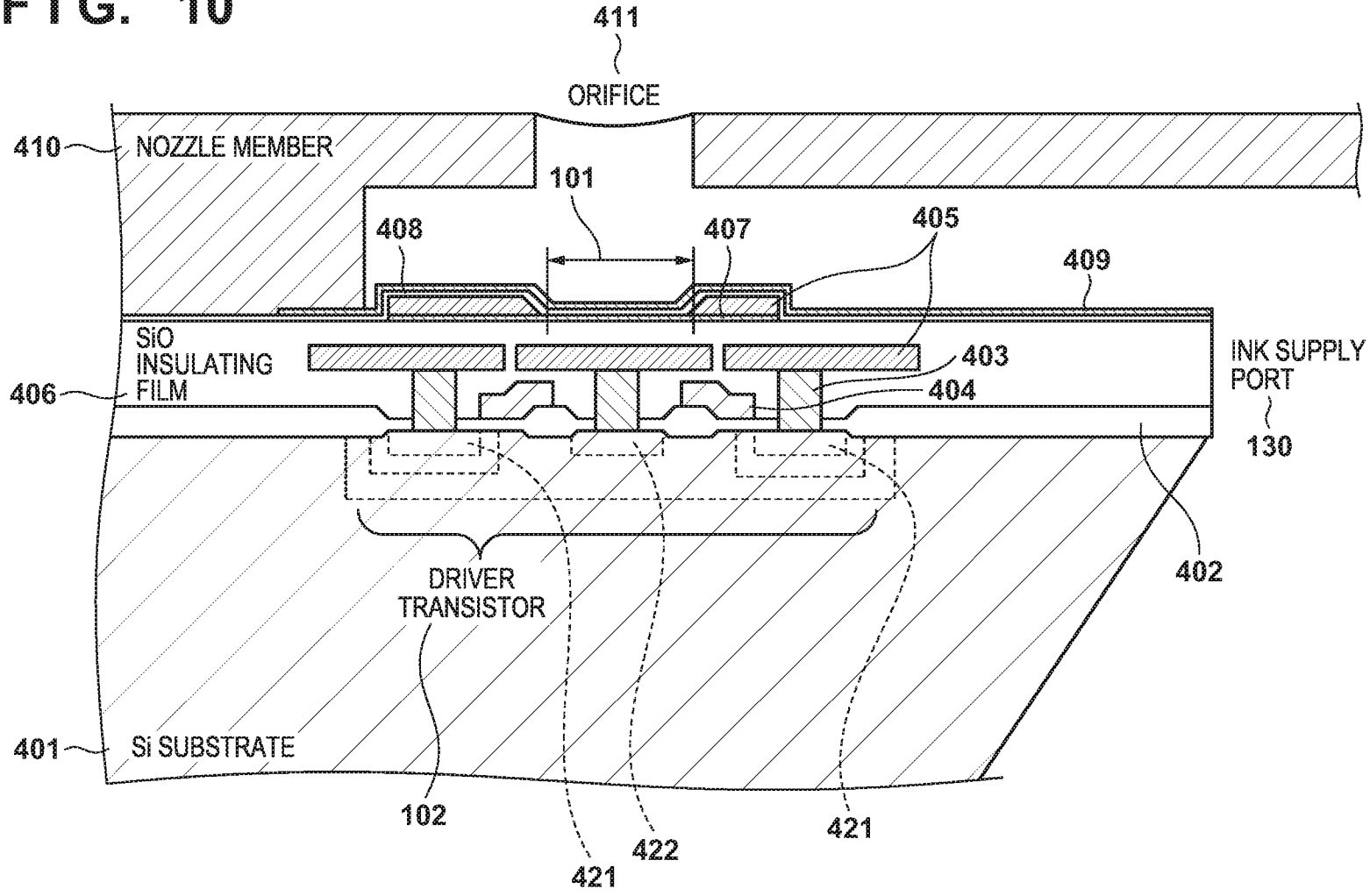
FIG. 10 is a view showing the section around a heater of the printhead substrate according to the first embodiment.

In order to describe the arrangement around each heater 101 of FIG. 6, FIG. 10 shows a section thereof. Referring to FIG. 10, the heater 101 is positioned immediately below an ink orifice 411, and the driver transistor 102 is further positioned immediately below the heater 101. That is, the heater 101 and the driver transistor 102 are arranged to be stacked (overlap) with each other. The driver transistor 102 is provided on an Si substrate 401. The respective terminals of the driver transistor 102 are electrically connected to source junctions 421, a drain junction 422, and gates 404. A Field oxide film 402 is provided on the Si substrate 401, and an SiO insulating film 406 is provided on the Field oxide film 402. A heater film 407 is provided on the SiO insulating film 406. The heater film 407 is deposited on the SiO insulating film 406 planarized by using a general planarization means such as CMP (Chemical Mechanical Polishing). Al wiring layers 405 serving as a pair of electrodes for sending electricity to the heater film 407 is provided on the heater film 407. An SiN protective film 408 is deposited on the heater film 407 and the Al wiring layers 405, and an anti-cavitation film 409 is further deposited on the SiN protective film 408. Ink supplied from the ink supply port 130 is discharged from the orifice 411 provided above the heater 101. The heater 101 is not electrically connected to the driver transistor 102 immediately below. Note that a portion of the heater film 407 which overlaps a heating unit in a stacking direction and contacts ink will be referred to as the heater 101. In this embodiment, a portion of the heater film 407 which overlaps a portion positioned between the Al wiring layers 405 serving as the pair of electrodes and contacts the ink will be referred to as the heater 101.

FIG. 9 shows, as a temperature 301 immediately below the heater, a change in temperature of each driver transistor 102 immediately below the corresponding one of the heaters 101 in accordance with driving of the heater 101 by a driving signal 201. In this embodiment, each driver transistor 102 is heated by the corresponding one of the heaters 101, and it takes a period for two blocks for the increased temperature thereof to drop to an ordinary temperature. In the arrangement of this embodiment, each driver transistor 102 immediately below the corresponding one of the heaters 101 is connected to the adjacent heater. That is, the driver transistor 102 immediately below the heater 101 which is influenced by the heat from the heater 101 is in a non-driving state. Then, a timing at which each driver transistor 102 heated by the heat from the corresponding one of the heaters 101 is driven occurs three blocks later indicated by the driving signal 202. Therefore, each driver transistor 102 according to this embodiment is not influenced by the heat from the corresponding one of the heaters 101 immediately above at a driving timing.

As described above, in a driving order considering the influence of ink crosstalk, the adjacent heaters are neither driven simultaneously nor continuously. Each heater is driven three or more blocks later, and thus the corresponding one of the driver transistors 102 is driven in a state in which its heat is radiated sufficiently, and its temperature returns to the ordinary temperature. Thus, in the arrangement according to this embodiment, it becomes possible to perform a circuit operation synchronized well with the driving order considering the influence of ink crosstalk at the ordinary temperature at all times.

Note that the circuit operation may not be performed in the driving order synchronized with the crosstalk as long as it is performed at a timing when the driver transistors 102 are not influenced by the heat. Further, driving need not necessarily be restricted until a temperature increased by the influence of the heat from the adjacent heater returns to an ordinary temperature, but the driver transistor may be driven at a timing when the temperature is decreased to an allowable temperature while avoiding the peak of the increased temperature.

Figure 11:
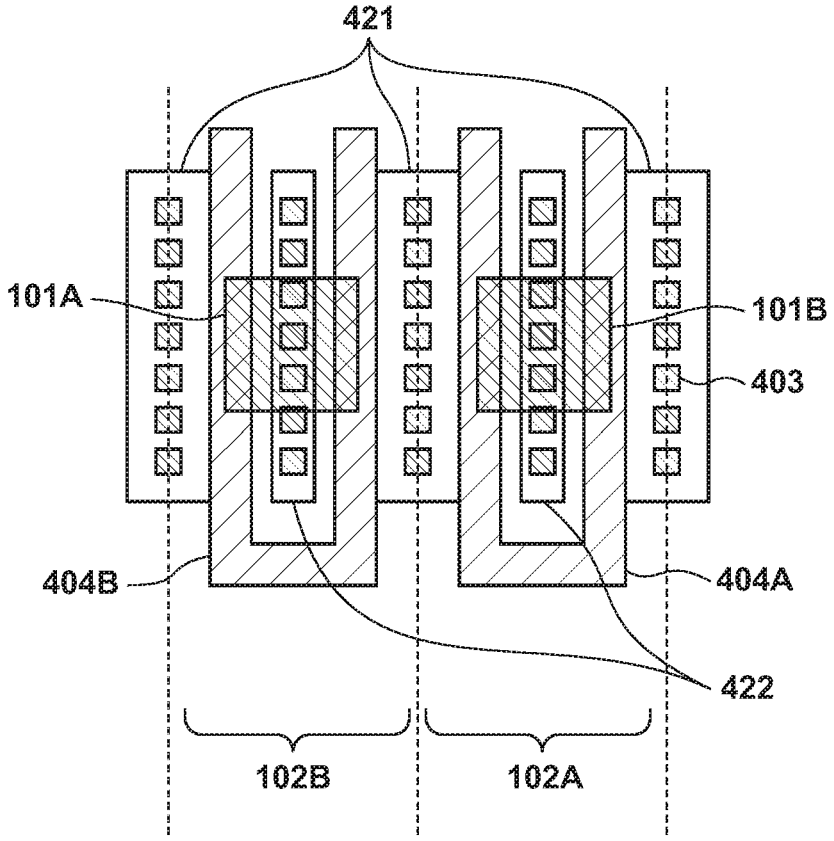
FIG. 11 is a view showing the layout around heaters of the printhead substrate according to the present invention.

FIG. 11 is a plan view showing the arrangement of the heaters 101 and the driver transistors 102. A driver transistor 102A drives a heater 101A, and a driver transistor 102B drives a heater 101B. A gate 404A switches on/off the driver transistor 102A. As described above, considering a direct heat influence at the driving timing of the heater 101A, it is desirable that the heater 101A and the driver transistor 102A are arranged apart from each other. In particular, the gate 404A and a gate 404B are important portions for deciding transistor characteristics, and it is therefore necessary that the gate 404A through which a heater current flows is not arranged immediately below the heater 101A. The source junctions 421 serving as the electrodes of the driver transistors 102A and 102B are also increased in resistance due to heat. It is therefore desirable that the heater 101A is not arranged immediately above the source junctions 421 so as not to be influenced by heat from the heater 101A when operating the driver transistor 102A.

Accordingly, in an arrangement considering the above, the driver transistors 102 immediately below the heaters 101 need not be transistors corresponding to the adjacent heaters. Referring to FIG. 6, the adjacent heaters are arranged to be replaced with each other in an arrangement in which the heaters and the driver transistors overlap each other. However, the present invention is not limited to such a combination. Letting one segment be the range of one driver transistor shown in FIG. 11, for example, if the driver transistor 102A and the heater 101A to be driven are spaced apart from each other by two or more segments, the direct heat influence at the driving timing is hardly received. However, a heat radiation period and the driving order avoiding the ink crosstalk may not be linked. As described above, if a block driving order shown in FIG. 9 is 1→4→7→2→5→8→3→6, the driver transistor 102A is driven three blocks later after being heated when the driver transistors are arranged in adjacent segments. In this case, if the driver transistor 102A is arranged at a position three segments away, the driver transistor 102A is driven in a heated next block, making it impossible to take a sufficient heat radiation period.

On the other hand, if the driver transistor 102A is arranged at a position four segments away, the driver transistor 102A is driven four blocks later after heating. This makes it possible to take the sufficient heat radiation period, as compared with a case in which the driver transistor 102A is arranged in the adjacent segment. Thus, when the driver transistors 102 and the heaters 101 are arranged apart from each other by two or more segments, they need to be driven in a block driving order considering both the heat radiation period and the crosstalk.

In the arrangement shown in FIG. 11, the regions of the heaters 101 and the driver transistors 102 completely overlap each other. It is possible, however, to obtain an effect of shrinking the layout area for the comparative example shown in FIG. 8 even if they are arranged so as to overlap only in part. In that case, the heat influence given by the heat from each heater 101 on the corresponding one of the driver transistors 102 is reduced, as compared with an arrangement in which they completely overlap each other.

Note that it is only necessary that the heater 101A serving as the first heat element and at least a part of the second driving circuit which drives the heater 101B (second heat element) serving as a block different from this are arranged to overlap each other. In such an arrangement, the first driving circuit configured to drive the heater 101A is never arranged to overlap the entire heater 101A. Alternatively, if the heater 101A and at least the part of the second driving circuit are arranged to overlap each other, a part of the heater 101A and a part of the first driving circuit configured to drive this may be arranged to overlap each other. This is because even in such an arrangement, it is possible to suppress the transmission of the heat generated in each heater 101 to a corresponding one of the driving circuits, as compared with the arrangement as shown in FIG. 8 in which the entire heater 101 and a part of the driver transistor 102 corresponding to this are arranged to overlap each other.

As described above, it becomes possible to arrange the circuits immediately below the heaters, and to implement a cost reduction and higher image quality while ensuring circuit durability and operation reliability.

Second Embodiment

Figure 12:
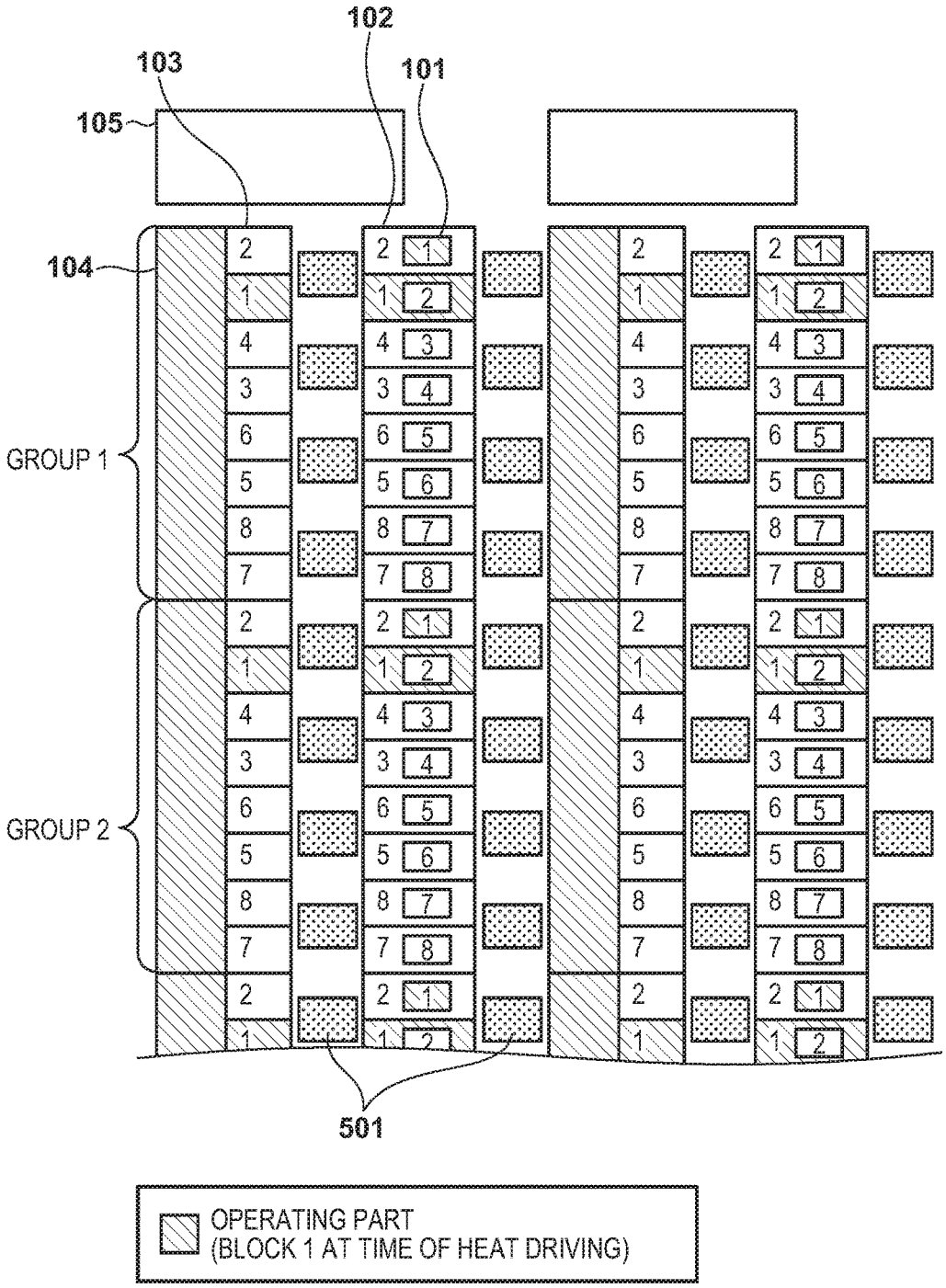
FIG. 12 is a view showing the circuit layout of a printhead substrate according to the second embodiment.

As the second embodiment according to the present invention, an arrangement will be described in which ink supply ports 501 are arranged symmetrically with respect to each heater (nozzle). FIG. 12 shows the circuit layout of a printhead substrate according to this embodiment. The ink supply ports 501 are arranged symmetrically with respect to each heater 101, and thus channels through which ink flows from the ink supply ports 501 to each heater 101 are also arranged symmetrically with respect to the heater 101. In an example shown in FIG. 10, ink is supplied from the ink supply port 130 to the heater 101 from one direction. On the other hand, in this embodiment, it is possible, by arranging the ink supply ports 501 so as to sandwich each heater 101, to supply the ink to each heater from two directions. This hardly gives a wave to a printed product, making it possible to discharge the ink stably. The circuit arrangement of FIG. 12 is the same as the arrangement of FIG. 4 described in the first embodiment, and thus a description thereof will be omitted.

As in FIG. 6 described in the first embodiment, driver transistors 102 corresponding to adjacent heaters are arranged immediately below the heaters 101. Note that in this embodiment, the ink supply ports 501 are arranged symmetrically with respect to each heater 101, and thus the heater 101 is arranged immediately above the central portion of a corresponding one of the driver transistors 102. Therefore, the driver transistors are influenced by the heat of the heaters arranged immediately above more easily than in the arrangement of FIG. 6. With the present invention, however, it is possible, by arranging each driver transistor 102 corresponding to the adjacent heater immediately below a corresponding one of the heaters 101, to make a difference in operation timing between the driver transistor and the heater overlapping each other. This further increases an effect of suppressing an influence by the heat from each heater at a timing when the corresponding one of the driver transistors operates.

Note that as described in the first embodiment, each driver transistor immediately below the corresponding one of the heaters may not be the driver transistor corresponding to the adjacent heater. On the condition that each driver transistor can be driven at an ordinary temperature, a driver transistor which drives a separated heater may be arranged.

Note that the arrangement of the ink supply ports 501 is not limited to the arrangement in which the ink supply ports 501 are arranged symmetrically with respect to each heater 101. An arrangement may be possible in which the arrays of the ink supply ports 501 are, respectively, arranged on both sides of the array of the heaters 101.

Third Embodiment

Figure 13:
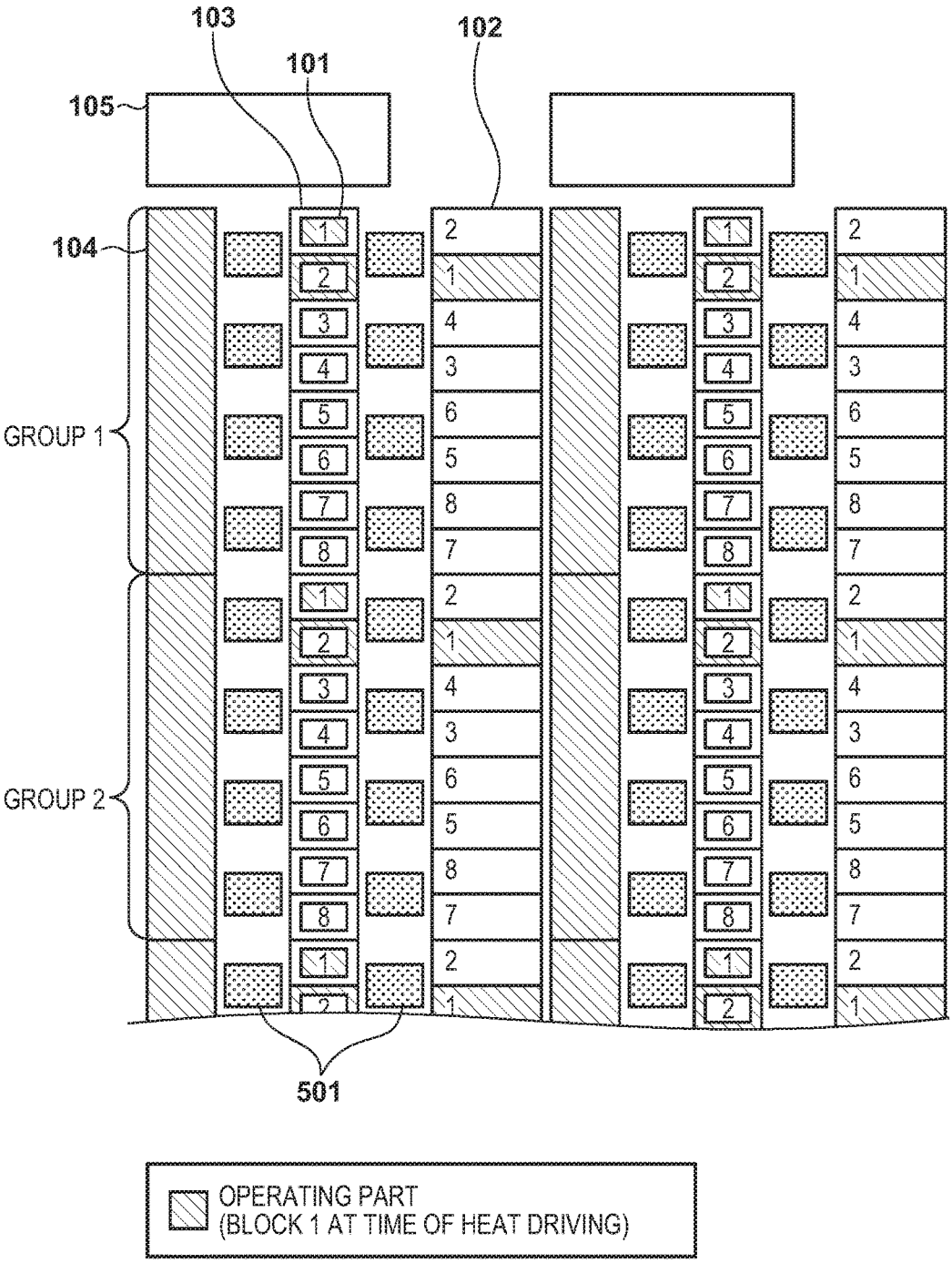
FIG. 13 is a view showing the circuit layout of a printhead substrate according to the third embodiment.

In the third embodiment, an arrangement will be described in which, as in the second embodiment, ink supply ports 501 are arranged symmetrically with respect to each heater (nozzle), and each preceding circuit 103 is further arranged immediately below a corresponding one of heaters 101. FIG. 13 shows the circuit layout of a printhead substrate according to this embodiment. The circuit arrangement is the same as in the first and second embodiments, and thus a description thereof will be omitted. Note that each preceding circuit arranged immediately below the corresponding one of the heaters 101 serves as the preceding circuit 103 corresponding to an adjacent heater.

As with driver transistors 102, each preceding circuit 103 has a one-to-one correspondence with the corresponding one of the heaters 101 and operates at the same timing. Therefore, as in the first and second embodiments, the preceding circuit 103 immediately below is set in a non-driving state at a timing when the preceding circuit 103 is heated by heat from the heater 101. Then, the preceding circuit 103 can be driven at a timing when a temperature increased by the heat from the heater 101 radiates heat sufficiently.

Both in the second and third embodiments, the distance between each heater 101 and a corresponding one of the ink supply ports 501 is dependent on the layout area of a circuit below the heater 101. As shown in FIG. 13, comparing each preceding circuit 103 with the corresponding one of the driver transistors 102, the preceding circuit 103 tends to have a smaller layout area. Therefore, it becomes possible to further reduce (shorten) the distance between the heater 101 (orifice) and the corresponding one of the ink supply ports 501 in the arrangement according to this embodiment than in the arrangement (FIG. 12) of the second embodiment. It is therefore possible, as compared with the second embodiment, to further increase an ink discharge frequency in this embodiment.

As described in the first embodiment with reference to FIG. 11, it is desirable that each heater 101 and a corresponding one of the preceding circuits 103 configured to drive that heater are arranged apart from each other in consideration of a direct heat influence at a driving timing. More specifically, parts influenced by the heat are the gate, source junction, and drain junction portions of the preceding circuits 103. Therefore, each preceding circuit 103 arranged immediately below the corresponding one of the heaters 101 need not be a preceding circuit corresponding to the adjacent heater if the preceding circuit 103 can be arranged so as not be influenced by the heat from the heater 101. For example, letting one segment be the range of one preceding circuit 103, the preceding circuit 103 corresponding to the heater 101 may be arranged apart from it by two or more segments. In that case, however, there is a driving pattern in which heat radiation is not synchronized with a driving order synchronized with crosstalk. It is therefore necessary to perform driving in a block order considering both the heat radiation and the crosstalk, as described above in the first embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-150547, filed Jul. 29, 2016, which is hereby incorporated by reference herein in its entirety.

What is claimed is:

1. An element substrate comprising:

a plurality of heat elements which include a first heat element and a second heat element configured to supply heat to a liquid for printing; and a plurality of driving circuits which include a first driving circuit configured to drive the first heat element and a second driving circuit configured to drive the second heat element, wherein the plurality of heat elements and the plurality of driving circuits are stacked and arranged on a surface of the element substrate, and wherein the first heat element is arranged so as to overlap at least a part of the second driving circuit when viewed from a direction perpendicular to the surface of the element substrate.

2. The substrate according to claim 1, wherein the first heat element is arranged so as not to overlap the first driving circuit.

3. The substrate according to claim 1, wherein the second heat element is arranged so as to overlap at least a part of the first driving circuit.

4. The substrate according to claim 3, wherein the second heat element is arranged so as not to overlap the second driving circuit.

5. The substrate according to claim 1, wherein the first heat element and the second heat element are arranged adjacent to each other.

6. The substrate according to claim 1, wherein the first heat element and the second heat element are not driven simultaneously.

7. The substrate according to claim 1, wherein each of the plurality of driving circuits includes a driver transistor and a control circuit configured to output a driving signal for driving the driver transistor in accordance with a control signal.

8. The substrate according to claim 7, wherein the first heat element is arranged so as to overlap at least a part of the driver transistor included in the second driving circuit, and the second heat element is arranged so as to overlap at least a part of the driver transistor included in the first driving circuit.

9. The substrate according to claim 7, wherein the first heat element is arranged so as to overlap at least a part of the control circuit included in the second driving circuit, and the second heat element is arranged so as to overlap at least a part of the control circuit included in the first driving circuit.

10. The substrate according to claim 1, wherein a timing at which the first driving circuit drives the first heat element is controlled so as to avoid a timing at which a temperature of the first driving circuit which is increased by heat generated when the second heat element is driven reaches a peak.

11. The substrate according to claim 1, wherein supply ports of the liquid are provided so as to sandwich each of the plurality of heat elements, and the liquid is supplied, from two directions, to orifices of the liquid which, respectively, correspond to the plurality of heat elements.

12. The substrate according to claim 1, wherein each of the plurality of heat elements is arranged to overlap one of parts which form the plurality of driving circuits such that a distance from each supply port of the liquid to the orifice corresponding to each of the plurality of heat elements becomes the shortest.

13. A printhead comprising at least one element substrate, wherein the element substrate includes a plurality of heat elements which include a first heat element and a second heat element configured to supply heat to a liquid for printing, and a plurality of driving circuits which include a first driving circuit configured to drive the first heat element and a second driving circuit configured to drive the second heat element, the plurality of heat elements and the plurality of driving circuits are stacked and arranged on a surface of the element substrate, and the first heat element is arranged so as to overlap at least a part of the second driving circuit when viewed from a direction perpendicular to the surface of the element substrate.

14. A printing apparatus comprising at least one printhead which includes at least one element substrate, wherein the element substrate includes a plurality of heat elements which include a first heat element and a second heat element configured to supply heat to a liquid for printing, and a plurality of driving circuits which include a first driving circuit configured to drive the first heat element and a second driving circuit configured to drive the second heat element, the plurality of heat elements and the plurality of driving circuits are stacked and arranged on a surface of the element substrate, and the first heat element is arranged so as to overlap at least a part of the second driving circuit when viewed from a direction perpendicular to the surface of the element substrate.

* * * * *